US006073954A

United States Patent [19]

Guiguet et al.

[11] Patent Number: 6,073,954

[45] Date of Patent: Jun. 13, 2000

[54] GLIDING BOARD HAVING AN IMPROVED INTERNAL STRUCTURE

[75] Inventors: Jacques Guiguet; Jacky Christoud, both of Voiron, France

[73] Assignee: Skis Rossignol S.A., France

[21] Appl. No.: 09/013,342

[22] Filed: Jan. 26, 1998

[30] Foreign Application Priority Data

Jan. 27, 1997 [FR] France ..... 97 01024

[51] Int. Cl.[7] ..... A63C 5/00

[52] U.S. Cl. ..... 280/601; 280/610

[58] Field of Search ..... 280/601, 610, 280/14.2, 602

[56] References Cited

U.S. PATENT DOCUMENTS

| | | | |
|---|---|---|---|
| 3,897,074 | 7/1975 | Tiitola | 280/11.13 |
| 5,186,777 | 2/1993 | Perenon et al. | 156/79 |
| 5,544,908 | 8/1996 | Fezio | 280/610 |
| 5,851,331 | 12/1998 | Grenetier et al. | 156/235 |
| 5,855,389 | 1/1999 | Andrus et al. | 280/602 |

FOREIGN PATENT DOCUMENTS

| | | |
|---|---|---|
| 428886 | of 1991 | European Pat. Off. . |
| 2654645 | of 1992 | France . |
| 2679780 | of 1993 | France . |
| 2711682 | of 1995 | France . |

*Primary Examiner*—Kevin Hurley
*Assistant Examiner*—Kevin McKinley
*Attorney, Agent, or Firm*—Wall Marjama Bilinski & Burr

[57] ABSTRACT

A gliding board including:

a lower assembly (1) which constitutes the gliding sole (2) and may or may not be bordered by edges (3, 4);

an upper assembly (5) comprising at least one outer layer forming the upper face (6) and the flanks (7, 8), a core (10) which is intended to fill the space contained between the lower assembly (1) and the upper assembly (5) and consists of an expanded polyurethane foam;

at least one reinforcing element (15, 16) which is arranged under the outer layer (6) and/or on the sole (2) and is impregnated with a cross-linked resin;

an intermediate bonding element (17, 18) interposed between the reinforcing element (15, 16) and the filling core (10), wherein said intermediate bonding element (17) consists of a porous sheet, coated and partially sealed on each face with a latex-based solution so that the face in contact with the core (10) is superficially impregnated with polyurethane foam, and the face in contact with the upper assembly (5) is superficially impregnated with the resin of the reinforcing element (15).

9 Claims, 1 Drawing Sheet

GLIDING BOARD HAVING AN IMPROVED INTERNAL STRUCTURE

BACKGROUND OF THE INVENTION

The invention relates to the field of sports involving gliding over snow, for example alpine skiing, cross-country skiing, snowboarding and monoskiing or the like. It more precisely concerns an improvement to the internal structure of the boards for engaging in these sports, improving their mechanical structure and their dynamic behavior.

In the rest of the description, the invention is described more precisely in its application to a piste ski, adaptation to the other types of gliding boards being obvious to the person skilled in the art.

As is known, a modern alpine ski is made by assembling various superimposed elements.

Thus, in a traditional ski, there is a lower assembly constituting the gliding surface, and an upper assembly including the upper face proper and the side flanks. A core, made either of wood, a honeycombed structure or foam, in particular polyurethane foam, is interposed between these upper and lower assemblies.

In "monocoque" skis, the upper assembly consists of the upper layer, the extensions of which are inclined to form the side faces of the ski.

As is known, it proves necessary to incorporate reinforcing elements between the core and the upper assembly, or the core and the lower assembly. These reinforcing elements, generally consisting of textile webs such as glass fiber fabrics impregnated with a thermoset resin, reinforce the mechanical qualities of the ski and thus improve its dynamic behavior.

Of the various methods for making gliding boards, one of the fastest ones is that referred to as "in situ injection". It consists in placing the constituent elements of the shell of the board in a mold, then injecting into them liquid components which react exothermically to form a polyurethane foam whose expansion pressure presses the shell elements against the walls of the mold, said foam also adhering to the constituent elements of the board.

Further, in order to manufacture skis of this type, the reinforcing elements are placed in the molds in a moist state, before the resin intended to give them the mechanical properties has cross-linked. This cross-linking will take place when the polyurethane foam constituting the core expands, by virtue of the heat released in the exothermic expansion reaction.

However, the resin of the reinforcing element and the polyurethane foam components have been found to be chemically reactive, that is to say that bringing them into contact, and therefore mixing them, impairs the cross-linking of the resin and modifies the reaction which leads to the formation of the polyurethane foam.

The problem which the invention proposes to solve therefore consists in avoiding or limiting the onset of undesired chemical reactions between the various chemical elements contained in the adjacent layers constituting the ski.

In document FR 2 654 645, it is proposed to interpose a leaktight plastic sheath between the lower and upper assemblies, into which sheath the polyurethane foam constituents which are intended to expand are injected. In this way, this sheath isolates the reinforcing element impregnated with epoxy resin from the polyurethane foam. Unfortunately, a solution of this type has a number of drawbacks, in particular the stretching of this plastic sheath which, in practice, leads to random deformations of this sheath and therefore inaccuracies in the positioning of the internal elements of the structure. This detrimentally affects the contact and adhesion between the various elements.

However, since a gliding board consisting of an assembly of layers undergoes flexing, it is essential for the layers to adhere perfectly so that they withstand the shear stresses generated by these deformations at the interfaces.

The second problem which the invention therefore proposes to solve is to permit optimum adhesion of the reinforcing element to the polyurethane foam core.

Lastly, it is known that, in behavior on snow, a gliding board made from a stack of rigidly assembled elements gives the sensation of a product which is dry, resilient, hard, harsh and therefore uncomfortable and very tiring.

SUMMARY OF THE INVENTION

The invention therefore relates to a gliding board including:

- a lower assembly which constitutes the gliding sole and may or may not be bordered by edges;
- an upper assembly comprising at least one outer layer forming the upper face and the flanks,
- a core which is intended to fill the space contained between the lower assembly and the upper assembly and consists of an expanded polyurethane foam;
- at least one reinforcing element which is arranged under the outer layer and/or on the sole and is impregnated with a cross-linked resin;
- an intermediate bonding element interposed between the reinforcing element and the filling core.

This board is one wherein said intermediate bonding element consists of a porous sheet, coated and partially sealed on each face with a latex-based solution so that the face in contact with the core is superficially impregnated with polyurethane foam, and the face in contact with the upper assembly is superficially impregnated with the resin of the reinforcing element. In this way, both the foam and the resin adhere to said characteristic intermediate element, but without becoming mixed. During manufacture, the intermediate element remains porous enough to be superficially impregnated by the polyurethane foam and by the resin of the reinforcing element.

Put another way, the structure of a ski according to the invention has a highly specific bonding intermediary permitting adhesion of both the polyurethane foam and the reinforcing element which is impregnated with epoxy resin, this being by virtue of an adjustment in its porosity which allows partial penetration of the polyurethane foam and the epoxy resin. This penetration results in firm attachment and therefore adhesion which is greatly improved in comparison with the use of a smooth-surfaced leaktight plastic film. Further, this coating needs to be partial because it must be sufficient for there to be penetration by the foam and the resin, but must be limited so that these two components (foam and resin) do not come into contact with one another. The porosity therefore needs to be tailored so that, after the foam and the resin have cross-linked, the penetration depths do not entail contact between these two components.

Further, the material used for this partial coating of the bonding intermediary gives this element some capacity for elastic deformation, the benefit of which is that it permits a slight relative movement of the layers in question when the ski is being deformed, and this shearing in the coating layer both improves the strength of the gliding board in terms of dynamic deformation and causes some of the vibrational energy to be absorbed. This improves the dynamic behavior of the ski.

In practice, the porous sheet may be made either of paper or of an optionally needled fibrous web, such as a non-woven based on polyester fibers, cellulose fibers or glass fibers, or alternatively a fabric.

In practice, the porosity of the textile sheet is advantageously between three and one hundred liters per square meter per second. This measure of porosity corresponds to the volume of air which crosses a unit area of the sheet in a unit time under a pressure difference of 196 pascal between the two faces of the sheet, according to the specifications of AFNOR standard NFG 07-111.

This is because it has been observed that, below three liters per square meter per second, the intermediate bonding element is too impermeable and does not allow the two liquid components (the resin and the constituents of the foam) to penetrate to a sufficient depth. The resulting attachment and adhesion are therefore not sufficient to obtain the requisite mechanical qualities.

On the other hand, above one hundred liters per square meter per second, the intermediate bonding element is too porous, and the polyurethane foam and the epoxy resin penetrate too deeply into the intermediate bonding element and come into contact with one another. The result of this, in these contact regions, is randomly distributed adhesion defects, which make it impossible for the assembly to be consolidated properly.

In practice, the dry extract mass of the latex-based solution coating the porous sheet is advantageously between 10 and 50% of the mass of the porous sheet. The term latex is intended, very generally, to comprise all emulsions of certain synthetic macromolecular substances, as well as natural latex.

In practice, the reinforcing elements coated with epoxy resin may be arranged either above the core, that is to say below the outer layer, or below the core, that is to say above the sole, or alternatively on the side faces of the core.

BRIEF DESCRIPTION OF THE FIGURES

The way in which the invention may be embodied, as well as the advantages which result therefrom, will emerge clearly from the description of the following organization schemes, supported by the appended figures, in which.

DETAILED DESCRIPTION OF THE INVENTION

As already stated, the invention relates to a gliding board intended for engaging in alpine skiing, cross-country skiing, monoskiing or snowboarding. The rest of the description and the figures will particularly concern the description of a piste ski, but adaptation to the other types of gliding board is obvious to the person skilled in the art.

Figure 1:
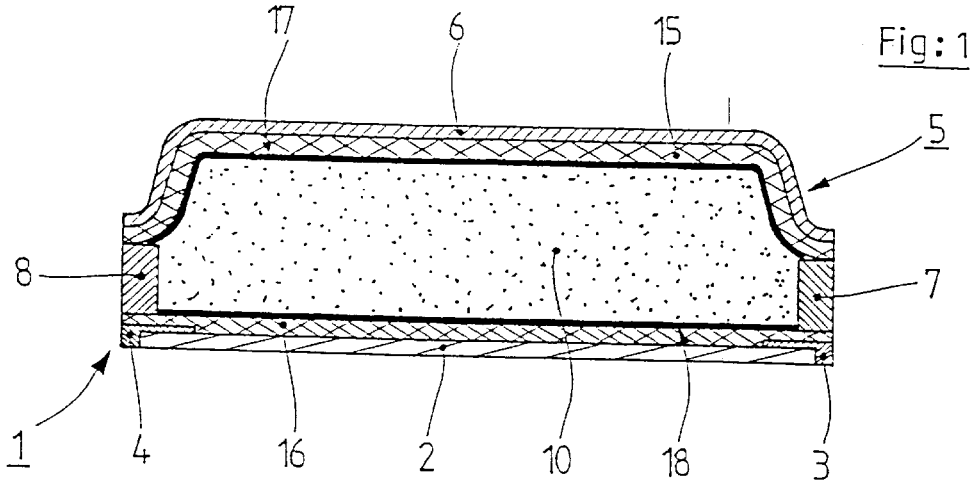
FIG. 1 is a sectional view of a monocoque ski having flanks according to the invention.

Thus, a ski as illustrated in FIG. 1 essentially comprises:

- a lower assembly (1) which comprises the sole (2) and is bordered by edges (3,4);
- an upper assembly (5) which consists of the upper layer (6) forming the top of the board and part of the side flanks (7, 8), as well as the side flanks (7, 8) proper;
- an injected core (10) filling the space between the lower assembly (1) and the upper assembly (5).

In known fashion, this core is made of expanded polyurethane foam. This foam results from the reaction of various liquid chemical components such as a polyol, an isocyanate and possibly a foaming product, a dye, etc.

In known fashion, this ski structure also includes reinforcing elements (15, 16) arranged respectively under the upper layer (6) and on the lower assembly (1). These reinforcing elements consist of a glass fiber fabric or the like. Of course, the invention encompasses those variants in which only one of these reinforcing elements is used. These reinforcing elements (15, 16) are intended to give mechanical properties to the ski and consist of a glass fabric impregnated with an epoxy resin. These elements (15, 16) are, in particular, shaped to match the general upper shape of the ski during the expansion of the polyurethane foam subsequent to the injection of the core. Since the expansion reaction is highly exothermic, the heat which is released causes the epoxy foam to cross-link.

The structure of the ski essentially includes an intermediate bonding element (17, 18) interposed between the reinforcing element (15, 16) and the filling core (10).

According to the invention, this bonding intermediary (17, 18) consists of a porous fibrous web coated partially with a latex-based solution.

Various materials can be used in order for the intermediate bonding element (17, 18) to have sufficient porosity, such as paper, non-wovens or woven fabrics. The fibers used for the non-wovens or the fabric may be polyester fibers, cellulose fibers, glass fibers or the like. It is essential that this sheet does not constitute a leaktight barrier to the polyurethane foam or to the epoxy resin of the reinforcing element (15, 16), but allows some degree of penetration.

This penetration must be controlled and limited. This is achieved by virtue of the partial coating, or more precisely coating in a controlled quantity, with a latex-based solution. Thus, the mass of this solution coating the sheet is, in terms of dry extract, between 10 and 50% of the mass of the sheet, per unit area. Examples of latex-based solutions which make it possible to obtain the results of the invention include solutions based on butadiene, nitrile or natural rubber such as hevea.

Figure 3:
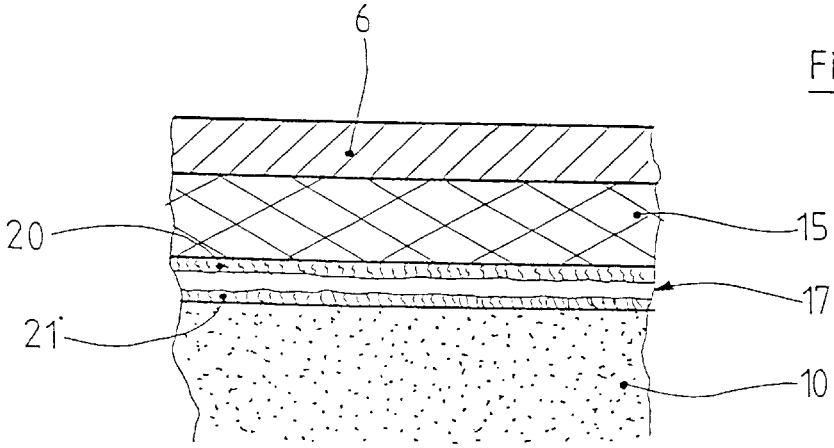
FIG. 3 is a detail section of the characteristic porous sheet and the adjacent elements.

As a consequence, when the porous sheet (17) is brought into contact with the resin-impregnated reinforcing element (15), the effect of pressure and temperature will cause the epoxy resin to flow and therefore superficially impregnate the upper face of the sheet (17). In addition, the constituent chemical elements of the polyurethane foam will also superficially penetrate the lower face of the porous sheet (17). This phenomenon is illustrated in FIG. 3, which shows that the epoxy resin of the reinforcement (15) penetrates the porous sheet (17) in the region (20), while the elements of the polyurethane foam of the core (10) penetrate the sheet (17) in the region (21). It is essential for this penetration to be limited by a controlled porosity, in order to prevent contact between the regions (20) and (21).

There are various solutions for adjusting the porosity level of the sheet (17) to the needs of the invention:

- using a variable-porosity support film,
- varying the dry extract quantity of the latex-based solution,
- varying the residual quantity of this solution either:
  - by modifying the rate at which the machine for impregnating the sheet delivers the solution,
  - by modifying the rate at which the sheet moves past the impregnation head, by modifying the calendering pressure of the coated film.

As seen in FIG. 3, the penetration of the polyurethane foam and epoxy resin into the sheet (17) allows the reinforcing elements to be attached very effectively to the intermediate bonding film, so that the tear strength is no longer limited by the adhesion of its interfaces, but by delamination inside the structure of the support film.

The measured and controlled coating of the sheet (17) ensures a second effect which is advantageous in terms of the dynamic behavior of the ski. Specifically, the latex-based solution gives the sheet (17) some capacity for elastic deformation and improves its shear strength. This allows the reinforcing element (15) to move slightly relative to the core, under the effect of the tensile and compressive stresses obtained on a flexurally deformed beam, which makes the ski more resistant to breakage, and provides a feeling of comfort due to the progressive nature of the deformations and the damping of some of the vibrations, which moderate the behavior of the ski.

Figure 2:
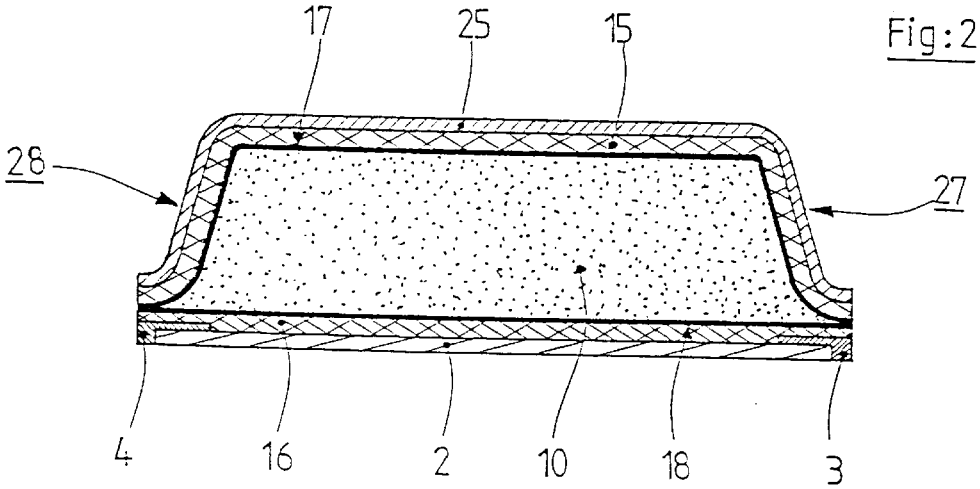
FIG. 2 is a sectional view of a monocoque ski according to the invention.

As can be seen in FIG. 2, the invention may also be applied to the production of "monocoque" skis in which the side faces (27, 28) consist of the side extensions of the upper layer (25).

The above description shows that using the characteristic porous sheet on skis, or more generally on gliding boards according to the invention, affords the following advantages:

by virtue of its porosity, the film acting as a bonding intermediary ensures good adhesion with the core and the reinforcing elements;

it prevents contact between the epoxy resin of the reinforcing element and the constituent elements of the polyurethane foam, these being known to be chemically incompatible;

the choice of a latex-based coating solution gives the intermediate bonding element some capacity for shearing, and thereby gives the ski improved dynamic behavior.

What is claimed is:

1. A gliding board comprising:

a lower assembly including a gliding sole;

an upper assembly including an outer layer, said outer layer including an upper face and flanks;

a polyurethane foam core positioned between said upper and lower assemblies;

a reinforcing element positioned under said outer layer, said reinforcing element impregnated with a cross-linked resin; and, an intermediate bonding element interposed between said reinforcing element and said core, said bonding element comprising a porous sheet, said porous sheet including a first face and a second face, said porous sheet coated and partially sealed on each of said faces with a latex-based solution, said porous sheet preventing said reinforcing element and said core from contacting each other, wherein said first face contacts said polyurethane foam core, said first face superficially impregnated with the polyurethane foam of said core, and said second face contacts said reinforcing element, said second face superficially impregnated with the resin of said reinforcing element.

2. The gliding board of claim 1, wherein said porous sheet comprises a textile web.

3. The gliding board of claim 1, wherein said porous sheet comprises paper.

4. The gliding board of claim 1, wherein said porous sheet has a porosity between three liters per square meter per second under a pressure of 196 pascal and one hundred liters per square meter per second under a pressure of 196 pascal.

5. The gliding board of claim 1 wherein said latex-based solution has a dry extract mass of between ten percent and fifty percent of the mass of said porous sheet.

6. The gliding board of claim 1 wherein said reinforcing element is positioned between said core and said outer layer.

7. The gliding board of claim 1 wherein said reinforcing element is positioned between said core and said lower assembly.

8. The gliding board of claim 2, wherein said textile web comprises a non-woven fibrous web.

9. The gliding board of claim 8, wherein said fibrous web comprises a material, said material selected from the group consisting of polyester fibers, cellulose fibers, or glass fibers.

* * * * *